US007338421B2

(12) United States Patent
Eusepi et al.

(10) Patent No.: US 7,338,421 B2
(45) Date of Patent: Mar. 4, 2008

(54) METHOD AND A DEVICE FOR MAKING FILTERS FOR TOBACCO PRODUCTS

(75) Inventors: Ivan Eusepi, Castel Maggiore (IT); Armando Turrini, S. Giovanni in Persiceto (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 309 days.

(21) Appl. No.: 11/002,075

(22) Filed: Dec. 3, 2004

(65) Prior Publication Data

US 2005/0150507 A1 Jul. 14, 2005

(30) Foreign Application Priority Data

Dec. 22, 2003 (IT) ..... BO2003A0769

(51) Int. Cl.
*B31C 11/00* (2006.01)

(52) U.S. Cl. ..... 493/39; 493/42; 493/46; 493/47; 53/461; 53/204; 53/205; 53/582

(58) Field of Classification Search ..... 493/39, 493/42, 46, 47–49, 941; 53/204, 205, 582, 53/461

See application file for complete search history.

(56) References Cited

U.S. PATENT DOCUMENTS

| | | | | |
|---|---|---|---|---|
| 2,160,201 | A * | 5/1939 | Maitland | 131/61.1 |
| 3,834,285 | A * | 9/1974 | Schubert et al. | 493/45 |
| 4,036,119 | A | 7/1977 | Schubert et al. | |
| 5,024,242 | A * | 6/1991 | Garthaffner et al. | 131/94 |
| 5,572,848 | A * | 11/1996 | Wall | 53/136.2 |
| 6,918,867 | B2 * | 7/2005 | Scherbarth et al. | 493/39 |
| 2002/0119873 | A1 | 8/2002 | Heitmann | |
| 2002/0119874 | A1 | 8/2002 | Heitmann et al. | |
| 2006/0281614 | A1 * | 12/2006 | Scott et al. | 493/39 |

FOREIGN PATENT DOCUMENTS

| | | |
|---|---|---|
| EP | 1226766 | 7/2002 |
| EP | 1228709 | 8/2002 |
| GB | 741429 | 12/1955 |

OTHER PUBLICATIONS

European Search Report dated Aug. 10, 2004.

* cited by examiner

*Primary Examiner*—Christopher Harmon
(74) *Attorney, Agent, or Firm*—Timothy J. Klima

(57) ABSTRACT

Filters for tobacco products are manufactured by a device comprising a conveyor drum rotatable about a horizontal axis and furnished with peripheral grooves, each holding a leaf of paper material preassembled with a first filter element. The single groove is flanked by two tubular elements arranged symmetrically on either side of the drum, slidable axially between a first position located externally of the groove and a second position located internally of the groove, also by pushers slidable within the respective tubular elements and serving to direct second and third filter elements into contact with the end faces of the first filter element in such a way that the second filter element, which consists in a measure of powder or granular material deposited in each tubular element by way of a spool valve, remains interposed between the first and the third filter element. The leaf of paper material is engaged by a folder mechanism associated with the groove and closed around the two tubular elements to form a tubular wrap.

17 Claims, 8 Drawing Sheets

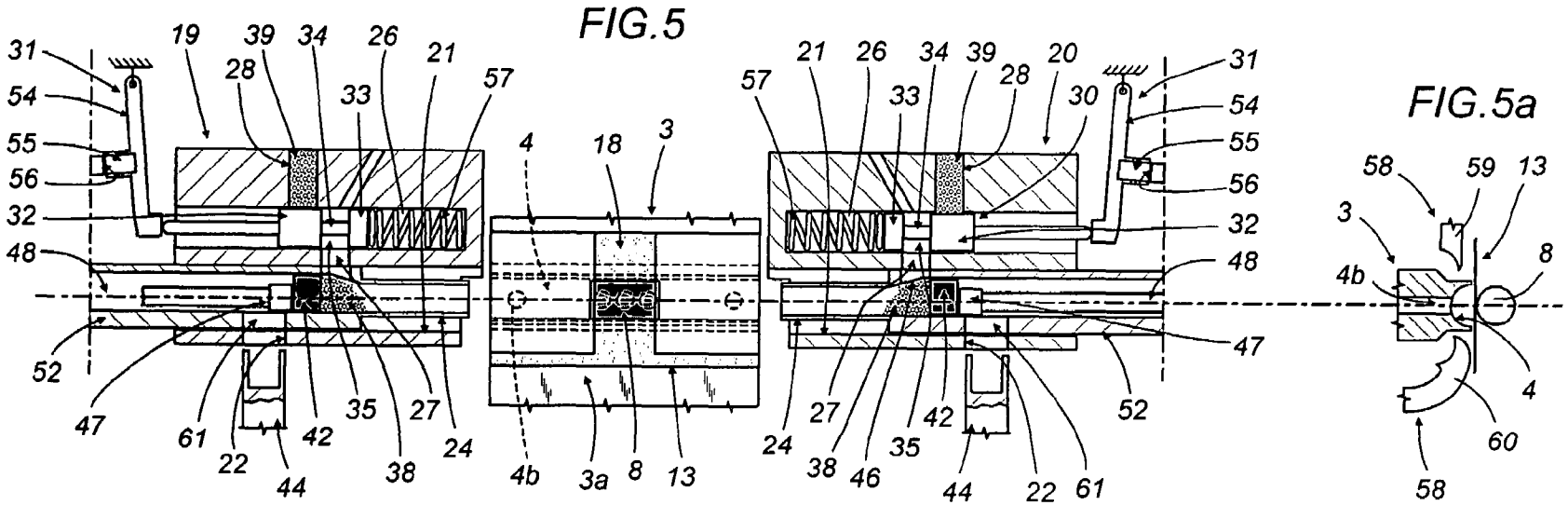
FIG.5a
FIG.5
13
8
4
59
60
58
3
4b
31
54
55
56
32
48
47
52
20
30
28
39
34
33
26
21
57
61
22
44
42
35
46
38
27
24
18
3a
19
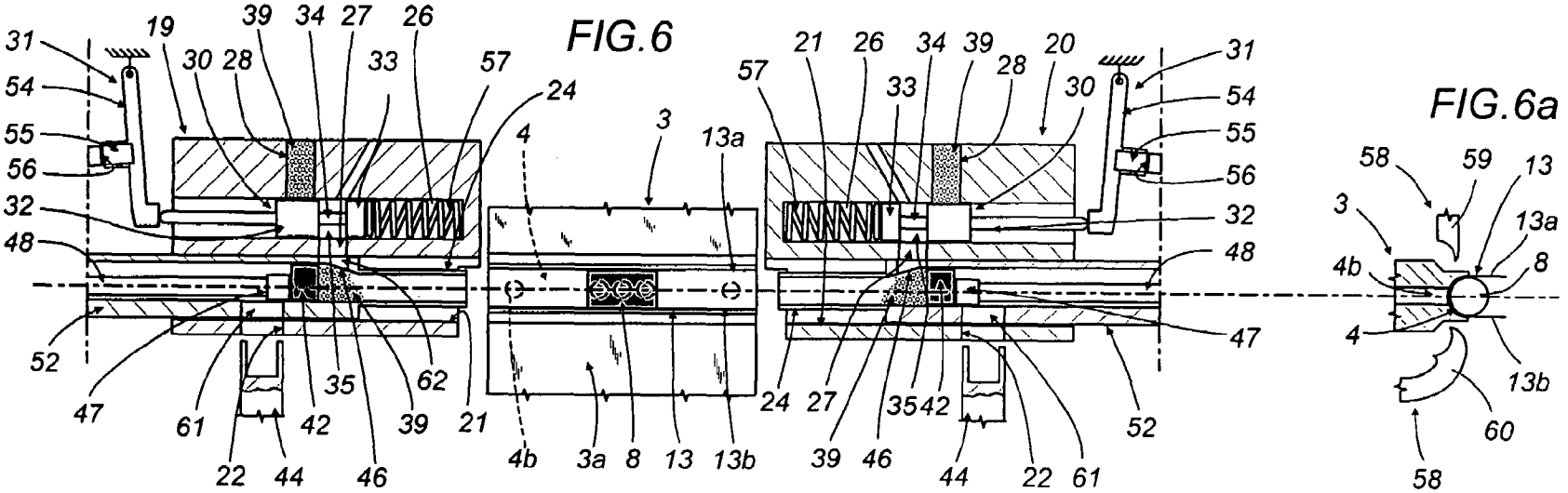
FIG.6a
FIG.6
13
13a
13b
8
4
59
60
58
3
4b
31
54
55
56
32
48
47
52
20
30
28
39
34
33
26
21
57
61
22
44
42
35
46
27
24
62
3a
19

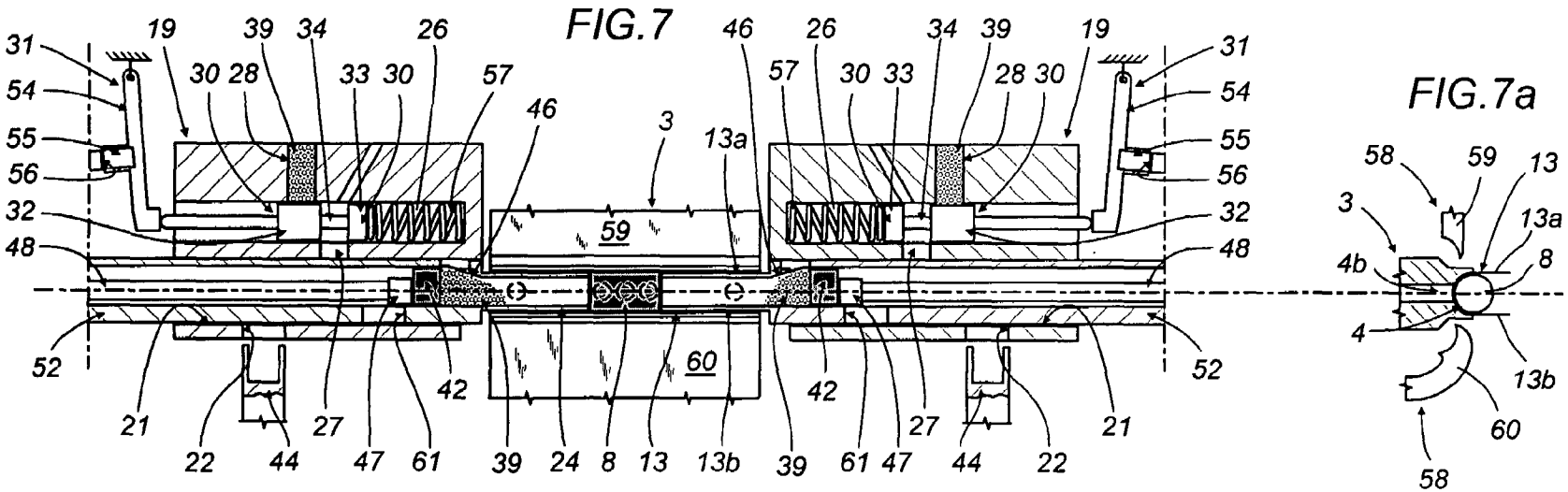
FIG.7a
FIG.7
3
4
4b
8
13
13a
13b
19
21
22
24
26
27
28
30
31
32
33
34
39
42
44
46
47
48
52
54
55
56
57
58
59
60
61
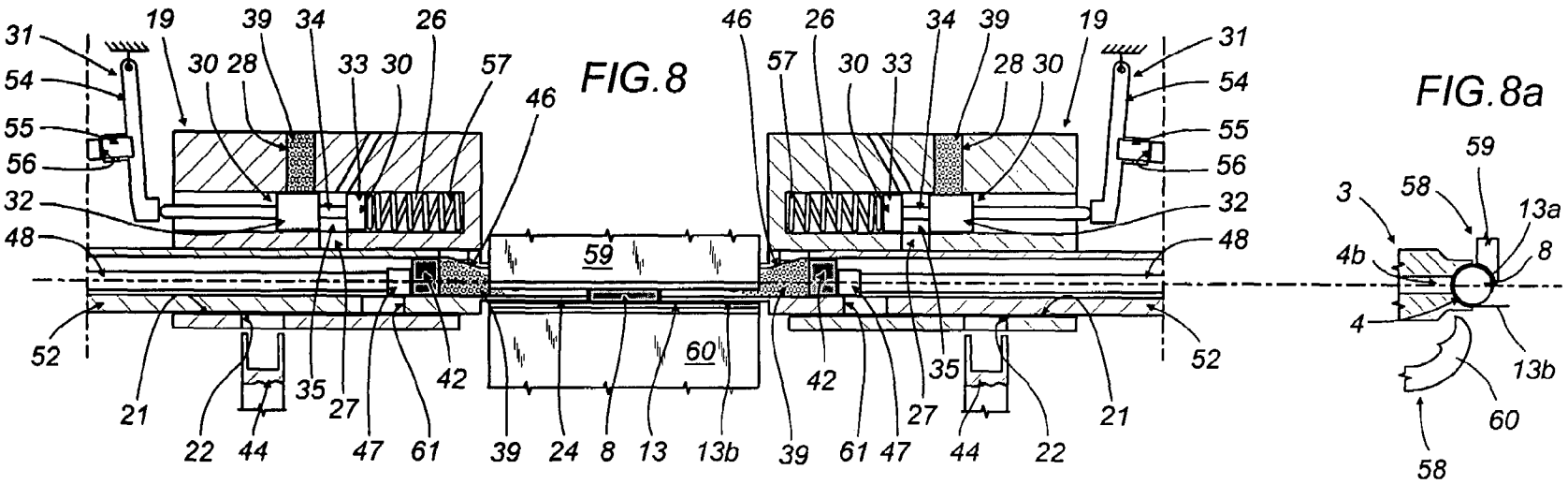
FIG.8a
FIG.8
3
4
4b
8
13
13a
13b
19
21
22
24
26
27
28
30
31
32
33
34
35
39
42
44
46
47
48
52
54
55
56
57
58
59
60
61

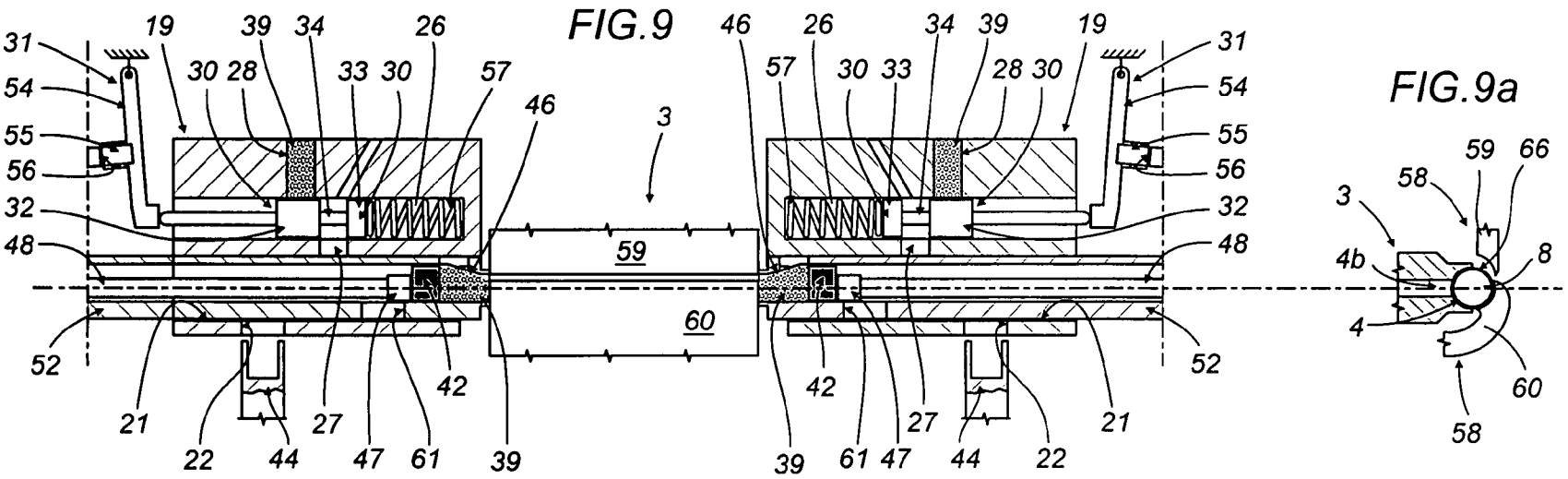
FIG.9a
FIG.9
3
4b
4
58
59
66
8
60
19
21
22
26
27
28
30
31
32
33
34
39
42
44
46
47
48
52
54
55
56
57
61
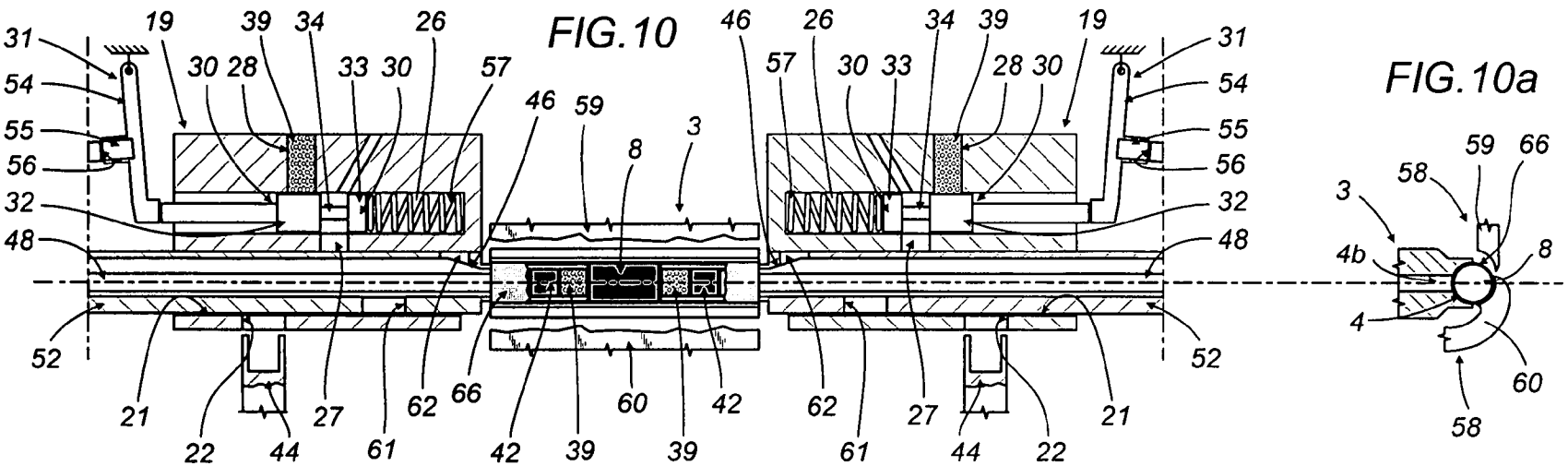
FIG.10a
FIG.10
3
4b
4
58
59
66
8
60
19
21
22
26
27
28
30
31
32
33
34
39
42
44
46
48
52
54
55
56
57
61
62

METHOD AND A DEVICE FOR MAKING FILTERS FOR TOBACCO PRODUCTS

This application claims priority to Italian Patent Application No. BO 2003 A 000769, filed Dec. 22, 2003, which is incorporated by reference herein.

BACKGROUND OF THE INVENTION

The present invention relates to a method and a device for making filters applicable to tobacco products.

The present invention finds useful application in the manufacturing sector concerned with tobacco products, typically cigarettes and the like.

Conventional cigarette filters consist generally in a cylindrical plug of artificial fibers obtained by spinning concentrated solutions of cellulose acetate.

The prior art also embraces composite filters that consist in a tubular plugwrap containing two or more component materials of dissimilar nature designed to improve filtration of the smoke.

For example, the more common composite filters comprise a tubular wrap of paper material in which two components of artificial fiber (acetate) are accommodated together with a further component of powder or granular material, interposed between the two fiber components.

Composite filters are fashioned by inserting the various filter components into the tubular wrap in ordered succession.

In particular, the tubular wrap is positioned vertically on a relative support, at a location coinciding with a feed station, beneath a number of rotary devices each supplying one respective filter component. Each of the rotary devices presents at least one pocket able to contain a relative filter component and positionable cyclically in alignment with the feed station.

Accordingly, the rotary devices will deposit the different filter components sequentially into the tubular wrap.

Once the filling step is completed, the assembled filter components are compressed from the top end of the tubular wrap by a plunger.

Whilst the conventional manufacturing devices outlined above are able to assemble composite type cigarette filters, such devices present certain drawbacks deriving in particular from the fact that they are unable to prevent the powder or granular material, during the feed step, from being released into the surrounding environment and thus causing damage to moving parts of the rotary devices.

A further drawback derives from the fact that during the steps of inserting and then compressing the filter components, the plunger can damage the tubular plugwrap, not least due to the presence of powder or granular material that may lodge between the plunger and the wrap.

Finally, another drawback affecting conventional devices for the assembly of composite filters is attributable to the method of feeding the component of powder or granular material. More exactly, the quantity of material inserted and compressed may be insufficient for the purpose and poorly compacted, with the result that its filtering properties are rendered ineffective.

The object of the present invention is to provide a method and a device for making filters applicable to tobacco products such as will be unaffected by the aforementioned drawbacks.

SUMMARY OF THE INVENTION

The stated object is realized in a method of making filters for tobacco products according to the present invention. The steps of such a method consist in feeding at least one leaf of paper material, inserting at least one filter component into at least one tubular element, placing the tubular element against an inner surface of the leaf, folding the leaf around the tubular element to form a tubular wrap, and finally, withdrawing the tubular element from the tubular wrap in such a way as to leave the at least one filter component lodged permanently within the wrap.

The stated object is realized similarly in a device designed to implement the method of making filters for tobacco products described above, which comprises a transport conveyor set in motion along a predetermined path and presenting a plurality of grooves each able to accommodate at least one leaf of paper material, at least one tubular element associated with each groove of the conveyor and capable of axial movement between a first position outside of the groove and a second position within the groove, also pushing means capable of movement through the tubular element and serving to transfer at least one filter component onto a relative leaf of paper material, and a plurality of mechanisms, each associated with a respective groove, by which the leaf of paper material is wrapped around the tubular element.

BRIEF DESCRIPTION OF THE DRAWINGS

The invention will now be described in detail, by way of example, with the aid of the accompanying drawings, in which:

FIGS. 3 to 12 are schematic side views showing a detail of the device in FIG. 1, illustrated in a succession of operating steps;

FIGS. 3*a* to 11*a* are schematic sectional views showing a further detail of the device, seen from the same direction as in FIG. 1 and illustrated in a succession of operating steps.

DESCRIPTION OF THE PREFERRED EMBODIMENTS

Figure 1:
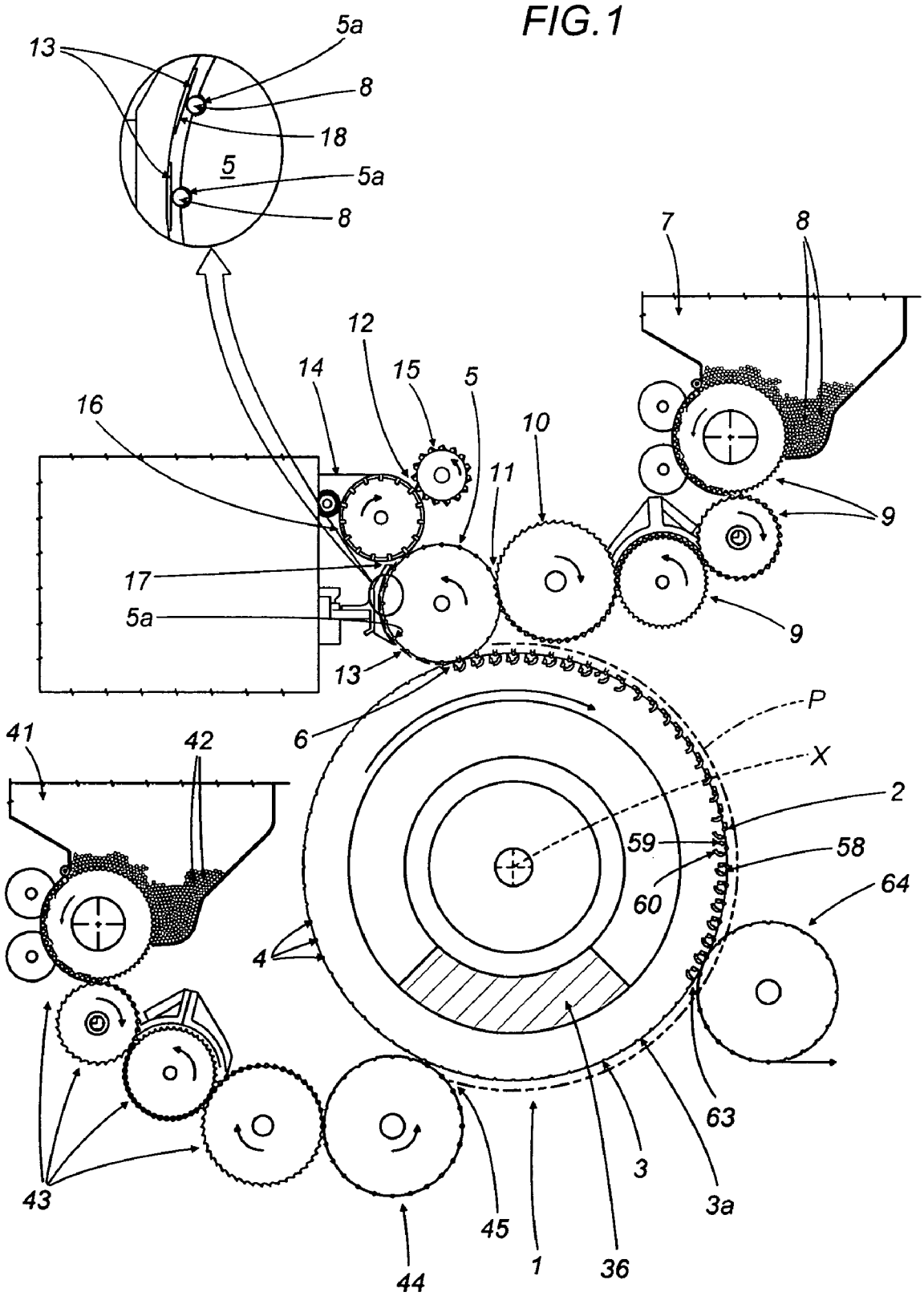
FIG. 1 illustrates a device for the manufacture of filters for tobacco products according to the present invention, viewed schematically in a front elevation and with certain parts omitted.

Referring to FIG. 1 of the drawings, 1 denotes a device, in its entirety, used in the manufacture of composite filters for tobacco products.

The device 1 comprises a transport conveyor 2 embodied as a drum 3 rotatable clockwise, as viewed in FIG. 1, about a horizontal axis X. The drum 3 presents a plurality of grooves 4 arranged around a cylindrical surface 3*a* of revolution and set in motion along a circular path P.

Operating above the conveying drum 3 is a loading drum 5 equipped with aspirating pockets denoted 5*a*, rotatable counterclockwise about an axis parallel to the axis X aforementioned in such a way as to revolve substantially tangential to the conveying drum 3 at a feed station denoted 6.

7 denotes a feed hopper dispensing first filter elements 8 of substantially cylindrical appearance obtained, for example, by spinning concentrated solutions of cellulose acetate.

The first filter elements 8 are taken up from the hopper onto a train 9 of rollers of which the final roller 10 rotates substantially tangential to the feeder drum 5 at a point of release 11 where the selfsame filter elements 8 are directed singly and in succession into respective aspirating pockets 5*a* of the drum 5.

12 denotes a device, in its entirety, by which partially gummed leaves 13 of wrapping material are fed to the loading drum 5. The single leaves 13 are separated from a continuous strip 14 by the action of a cutter unit 15 comprising a suction roller 16 that rotates tangentially to the feed drum 5 at a second point of release 17 downstream, considered relative to the rotation of the drum 5, from the point of release 11 first mentioned. Thus, each leaf 13 can be tacked by way of an intermediate first gummed portion 18 to a corresponding first filter element 8 occupying one of the aspirating pockets 5*a*.

The preassembled first filter elements 8 and leaves 13 are advanced by the loading drum 5 toward the feed station 6 and there transferred into the aforementioned grooves 4 of the conveying drum 3.

Figures 3, 3A, 4, 4A:
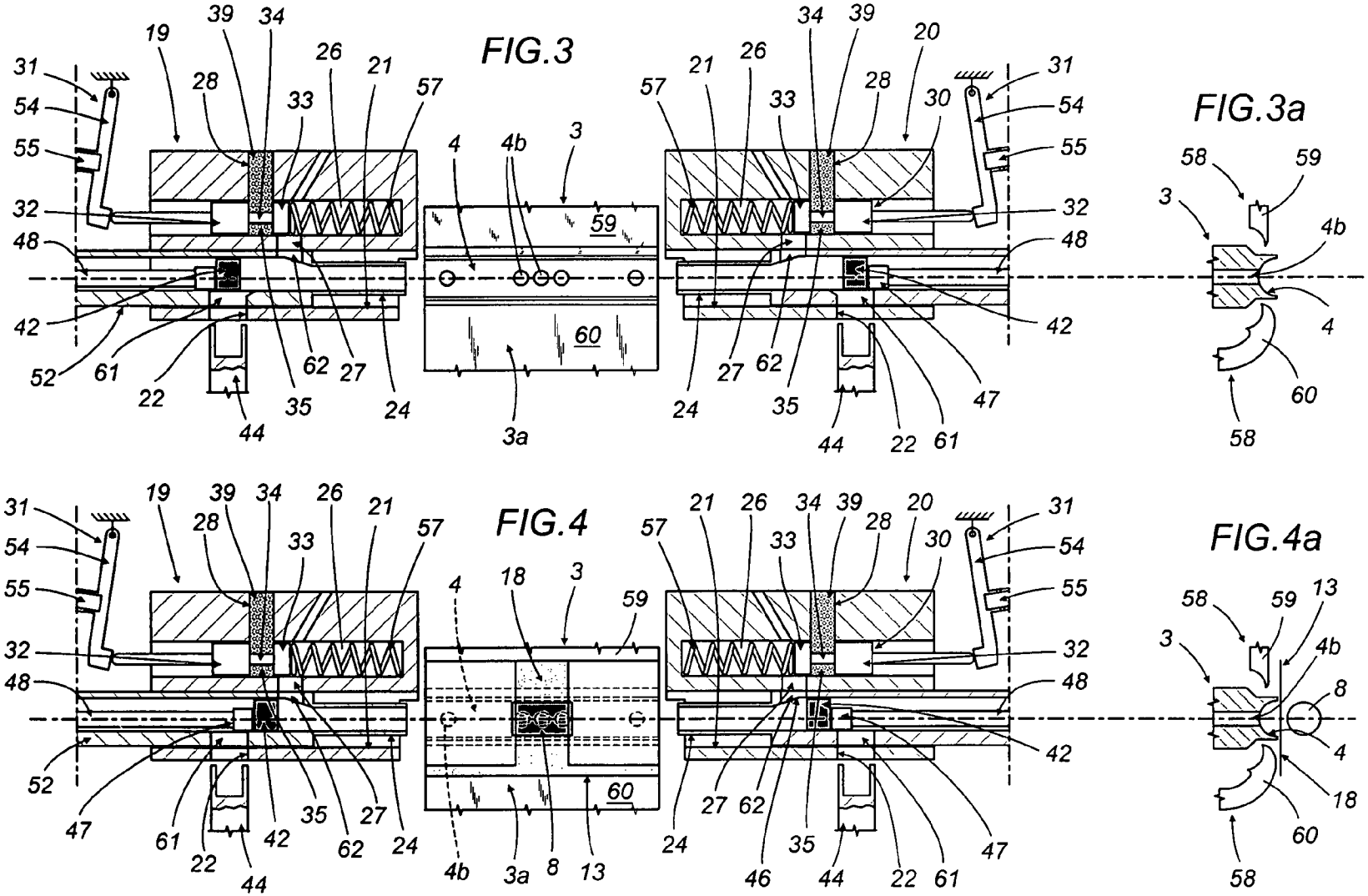

In particular, and as illustrated in FIGS. 3 and 3*a*, each groove 4 presents a cross section of substantially semicircular profile and is furnished with at least one suction hole 4*b* connected to a source of negative pressure not illustrated in the drawings.

Following the transfer, an intermediate portion of the outermost surface presented by the leaf 13 will be breasted in contact with the bottom of the groove 4, causing the leaf 13 to wrap partially around the respective first filter element 8 and assume a profile of U-shaped outline presenting two radially oriented members 13*a* and 13*b* (FIG. 6*a*).

As discernible in FIG. 2 and FIGS. 3 to 12, the transport conveyor 2 comprises a first and a second auxiliary roller denoted 19 and 20, aligned coaxially with the drum 3 and placed symmetrically one on either side.

Figure 2:
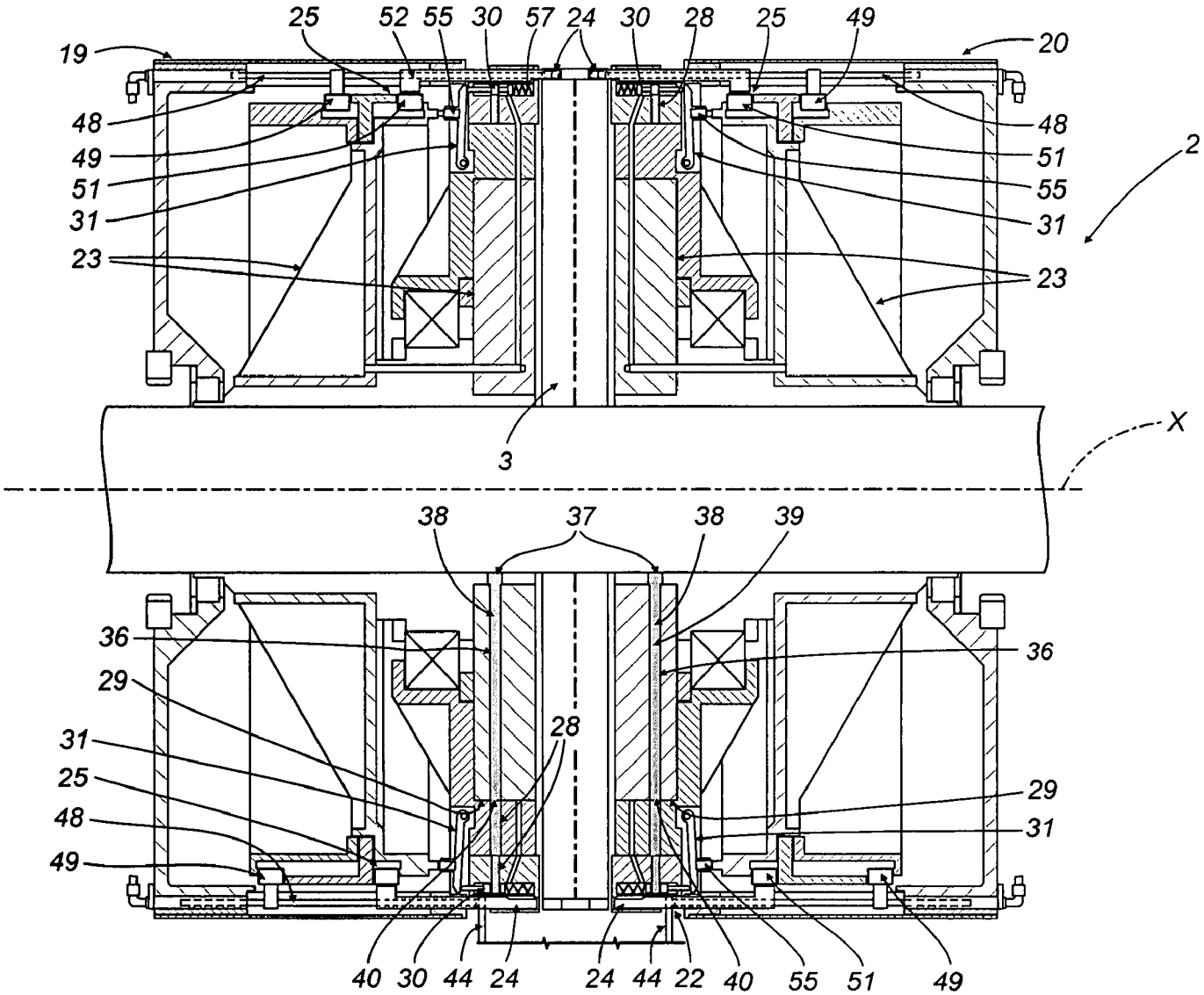
FIG. 2 shows a portion of the device in FIG. 1 illustrated schematically in section from one side.

With reference in particular to FIG. 2, the two auxiliary rollers 19 and 20 are rigidly associated with the drum 3, presenting substantially the same radial proportions as those of the selfsame drum 3, and mounted to respective fixed cylindrical hubs 23 with which they are also coaxial.

Figure 2A:
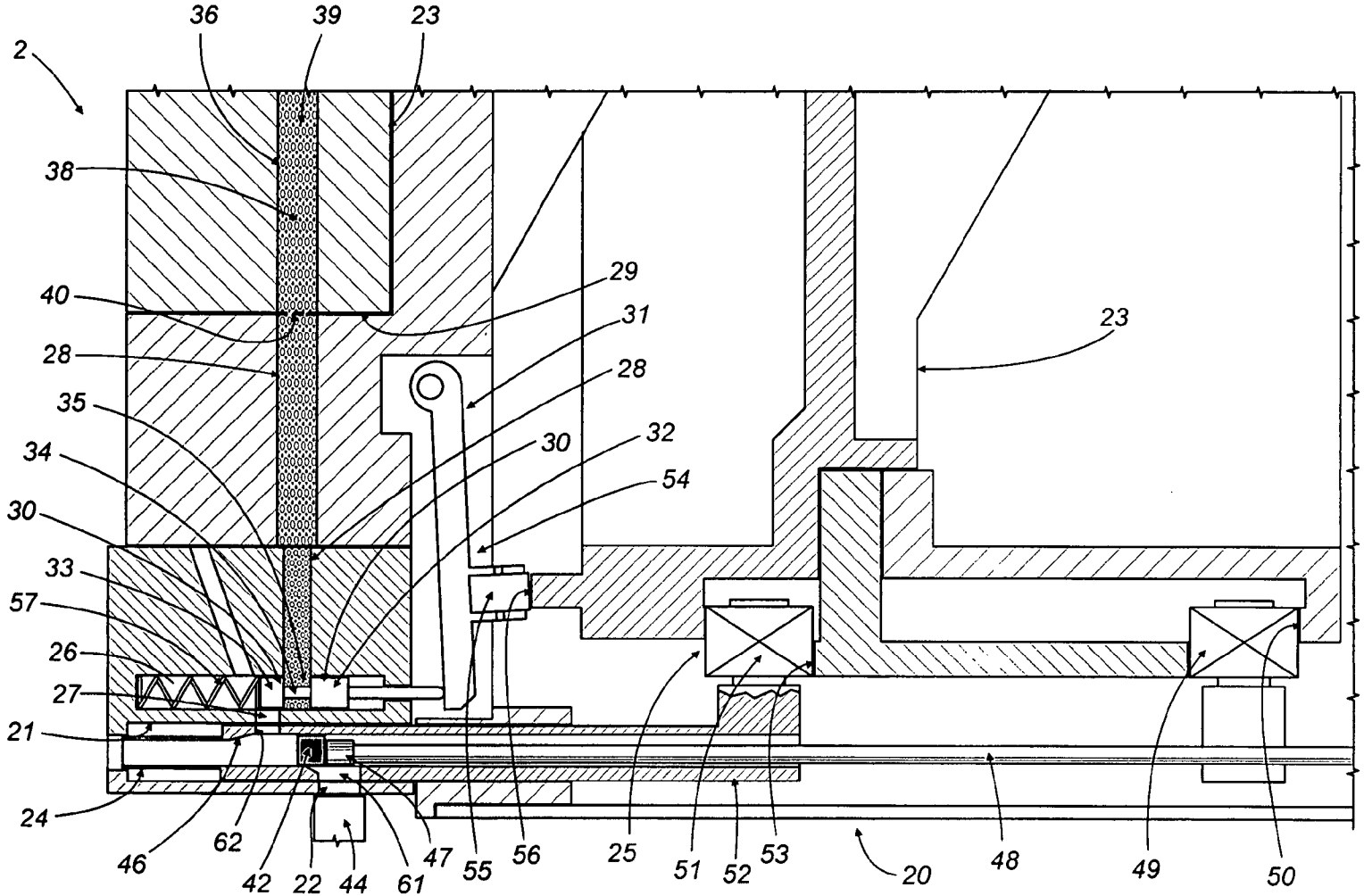
FIG. 2*a* shows an enlarged detail of the portion of the device illustrated in FIG. 2.

Referring particularly to FIG. 2*a*, which is a fragmentary view of the roller denoted 20, and to FIGS. 3 to 12, each roller 19 and 20 presents a peripheral portion furnished with axial ducts 21 corresponding in number to the grooves 4 of the conveying drum 3 and aligned coaxially with the selfsame grooves; each axial duct 21 presents a respective radial opening 22 communicating with the external environment.

As discernible in FIGS. 2 and 2*a* and FIGS. 3 to 12, each duct 21 houses a coaxially aligned tubular element 24 invested with sliding motion in the axial direction by actuator means, denoted 25 in their entirety, between a first position located externally of the relative groove 4 (FIGS. 3-6) and a second position located internally of the groove 4 (FIGS. 7-10).

Also associated with each axial duct 21, and occupying a part of the roller 19 and 20 radially nearer to the horizontal axis X, is a cylindrical cavity 26 aligned on a relative axis parallel to the selfsame axis X and connecting with the duct 21 by way of a hole 27.

The rollers 19 and 20 are furnished internally with radial channels 28, each connecting at one end with an intermediate part of a relative cylindrical cavity 26, and opening at the opposite end onto a cylindrical surface 29 presented by a portion of the respective fixed cylindrical hub 23.

Each of the cylindrical cavities 26 is occupied by a dispensing valve element 30 caused to slide along the selfsame cavity 26 in a close fit through the agency of respective actuator means 31.

The valve element 30 consists in two cylindrical elements 32 and 33 interconnected by a rod 34 of diameter smaller than that of the two cylindrical elements 32 and 33, in such a way that a space 35 is created between the cylindrical elements.

As illustrated in FIGS. 1 and 2, the bottom half of each fixed cylindrical hub 23 incorporates a cavity 36 appearing as a sector to a circle and extending through an arc of predetermined width, of which the top part presents an opening 37 serving to admit a powder or granular material 38 designed to function as a second filter element 39.

Each cavity 36 also presents a bottom opening 40 that coincides with the aforementioned cylindrical surface 29 in such a way that when the rollers 19 and 20 are set in rotation, the cavities 36 will be connected in succession to the radial channels 28 communicating with the corresponding cylindrical cavities 26.

The dispensing valve element 30 is capable of movement, generated by the aforementioned actuator means 31, between a receiving position, in which the space 35 is aligned with the outlet of the radial channel 28 and able to admit the powder or granular material 38 (as in FIGS. 3, 4 and 12), and a dispensing position in which the space 35 is aligned with the hole 27 mentioned previously and able to release the material 38.

41 denotes a feed hopper supplying third filter elements 42 of substantially cylindrical appearance obtained, for example, by spinning concentrated solutions of cellulose acetate, which are conveyed in pairs by way of a train 43 of rollers to a pair of discs 44 furnished with aspirating pockets and set in rotation substantially tangential to the drum 3 at a point of release 45 located upstream of the feed station 6, considered in relation to the rotation of the drum 3. The filter elements 42 are transferred by the discs 44 into the aforementioned radial openings 22 presented by the axial ducts 21 of the rollers 19 and 20.

Each filter element 42 transferred to a radial opening 22 is placed at the mouth of the tubular element 24, which presents a splayed entry portion denoted 46.

The third filter element 42 is engaged by pushing means 47 operating in coaxial alignment with the tubular element 24; such means 47 comprise a rod 48 of which the free end carries a wheel 49 positioned so as to roll, when the drum 3 is set in rotation, on a cam profile 50 presented by each of the fixed cylindrical hubs 23.

Similarly, the aforementioned actuator means 25 will comprise a wheel 51 carried by a first end of a sleeve 52 associated by way of a second end with the tubular element 24 and slidable thus internally of the axial duct 21. When the drum 3 is set in rotation, the wheel 51 rolls on a cam profile 53 presented by the fixed cylindrical hub 23.

Finally, the aforementioned actuator means 31 associated with each dispensing valve element 30 include a rocker arm 54 anchored pivotably at one end to the relative auxiliary roller 19 and 20 and presenting a wheel 55 located at an intermediate point along its length. When the drum 3 is set in rotation, the wheel 55 rolls on a respective cam profile 56 afforded likewise by each of the fixed cylindrical hubs 23, in such a way that the arm 54 will rock on its fulcrum pivot and thus cause the valve element 30 to reciprocate internally of the respective cylindrical cavity 26 against the action of a return spring 57.

As illustrated in FIGS. 3*a* to 11*a*, the device 1 further comprises folder mechanisms 58 associated with each groove 4 of the drum 3 and invested with rocking motion by respective actuator means (not illustrated in the drawings), of which the function is to shape the leaf 13 of material into a tubular wrap around the filter. More exactly, the folder mechanisms 58 comprise a first folder 59 serving to flatten the member 13*a* of the U-shaped leaf 13 of material located upstream, considered relative to the rotation of the drum 3, and a second folder 60 serving to flatten the downstream member 13*b* into partially overlapping contact with the member 13*a* flattened previously.

It will be observed that the free edges of the first folder 59 and the second folder 60 are shaped with cylindrically concave surfaces of which the radius of curvature substantially matches that of the grooves 4.

In operation, with the drum 3 and the rollers 19 and 20 set in rotation and a groove 4 (any groove, for the sake of example) moving into alignment with the cavities 36, a predetermined measure of powder or granular material 38 destined to provide the second filter elements 39, as will be made clear in due course, passes down the channels 28 and fills the spaces 35 of the valve elements 30 associated with each roller 19 and 20, as these occupy the receiving position of FIGS. 3 and 4.

At the same time, two third filter elements 42 are brought to the point of release 45 by the pair of discs 44 and transferred through the radial openings 22 into each of the two sleeves 52, which will have been drawn into a retracted position by the relative actuator means 25 and are fashioned each with a respective opening 61 aligned on the corresponding radial opening 22 (FIG. 3).

As the drum 3 continues rotating, the channels 28 of each roller 19 and 20 serving the particular groove 4 illustrated by way of example will pass beyond the limits of the openings 40 presented by the cavities 36 and each valve element 30, subject to the action of the relative rocker arm 54, is made to adopt the position of FIG. 5, closing off the radial channel 28 by means of the cylindrical element 32 and bringing the space 35 into alignment with the release hole 27, also with a corresponding hole 62 presented by each sleeve 52, through which a measure of the powder or granular material 38 constituting the second filter element 39 is able to drop into the sleeve 52.

In the same step, the third filter element 42 is forced inward by the rod 48 in such a way as to engage and lodge together with the second filter element 39 in the tubular element 24.

It will be observed that the forcible insertion of the second and third filter elements 39 and 42 into the tubular element 24 is facilitated by the splayed portion 46 of the mouth. Having located in the portion of the tubular element 24 that presents a constant diameter, the third filter element 42 functions as a stopper by sealing in the powder or granular material 38.

As the groove 4 under consideration passes into the feed station 6, it will receive a preassembled first filter element 8 and corresponding leaf 13 of wrap material from the loading drum 5, the leaf 13 assuming a U-profile as aforementioned.

As the drum 3 and the rollers 19 and 20 continue rotating toward a transfer station 63 occupied by a further take-up conveyor 64, the two sleeves 52 are caused by the relative actuator means 25 to move the tubular elements 24 into their second position, internally of the groove 4, and substantially into contact with the opposite end faces of the first filter element 8 as illustrated in FIG. 7.

Figures 11, 11A, 12:
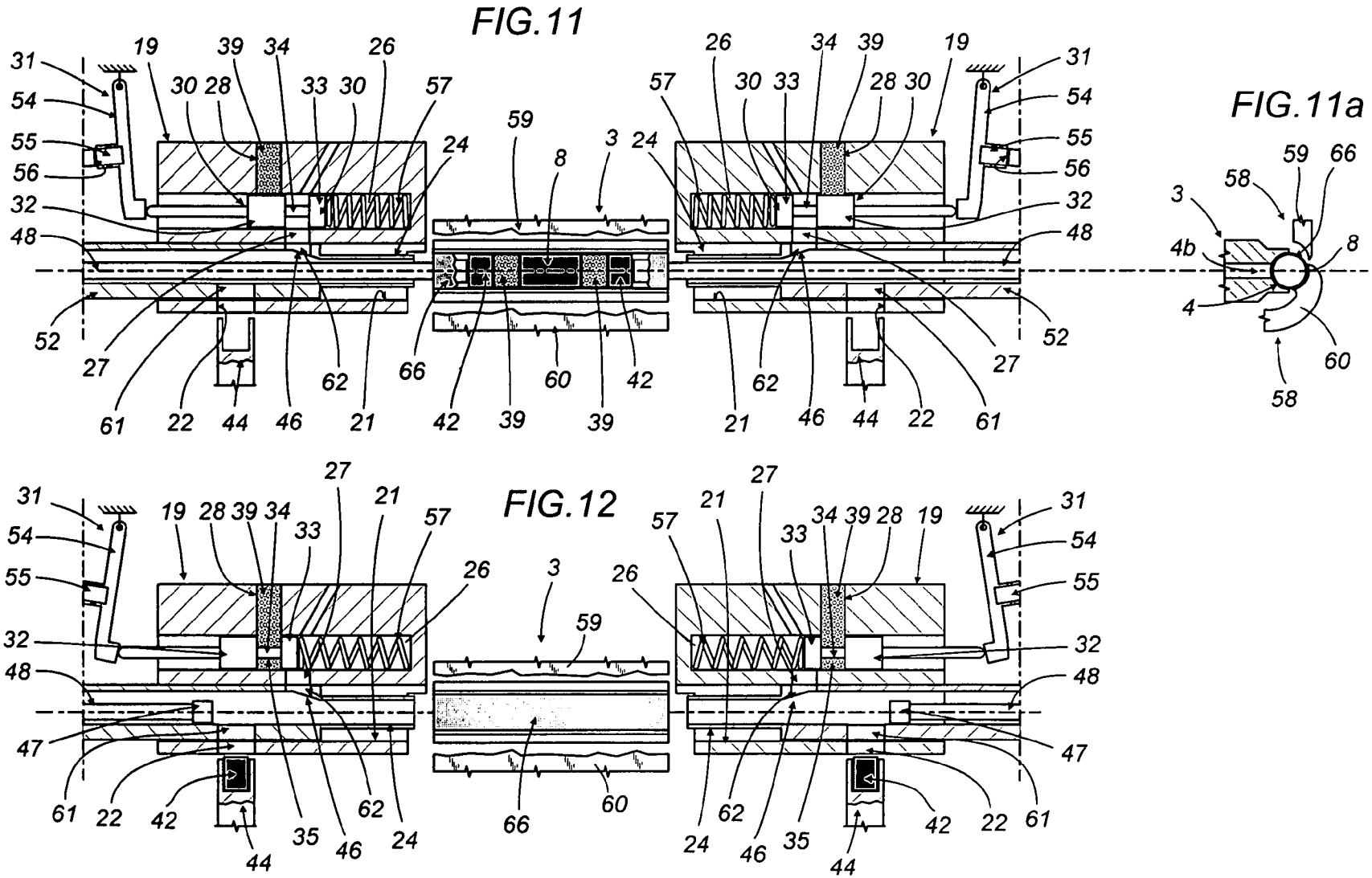

Observing FIGS. 8 to 12, the two rods 48 are caused by the respective wheels 49 moving along their cam profiles 50 to slide internally of the respective sleeves 52 and to force the respective second and third filter elements 39 and 42 through the respective tubular elements 24 until compacted against the opposite end faces of the first filter element 8 (FIG. 11).

As these steps proceed, the folder mechanisms 58 flatten the members 13*a* and 13*b* of the leaf one after the other, by means of the first folder 59 and the second folder 60, along the portion of the tubular element 24 exhibiting a constant diameter, so as to fashion a tubular wrap 66 containing a central first filter element 8 and two pairs of respective second and third filter elements 39 and 42 positioned either side of the first element 8. One edge of the outer member 13*b* presented by each leaf 13 is coated with a layer of gumming material such as will guarantee that the tubular wrap stays fastened.

Immediately upstream of the transfer station 63, as indicated in FIG. 12, the tubular elements 24 are retracted by the respective actuator means 25, withdrawn from the tubular wrap 66 and returned to their initial position located externally of the groove 4.

Thereafter, the rods 48 likewise are retracted and the pushing means 47 returned to their initial position.

It will be seen that when subject to the action of the return springs 57, the valve elements 30 slide within the cylindrical cavities 26 back to the position in which the spaces 35 are able to receive the powder or granular material 38.

The device further comprises air ducts 65 formed both in the fixed cylindrical hubs 23 and in the auxiliary rollers 19 and 20, which emerge into the cylindrical cavities 26.

Each of the filters assembled as described above is cut transversely to produce two single filters, each in turn combining with a single cigarette stick to create a filter tipped cigarette.

What is claimed:

1. A method of making filters for tobacco products, comprising the steps of:

feeding at least one leaf of paper material;

inserting at least one filter component into at least one tubular element;

placing one tubular element against an inner surface of the leaf;

folding the leaf around the tubular element to form a tubular wrap;

withdrawing the tubular element from the tubular wrap in such a way as to leave the at least one filter component lodged permanently within the selfsame wrap.

2. A method as in claim 1, comprising the step, preceding the step of placing the tubular element against the leaf, of placing a further filter component against the inner surface of he leaf of paper material.

3. A method as in claim 2, wherein the step of placing the tubular element includes the subsidiary steps of moving the tubular element toward the further filter component, and positioning the tubular element in close proximity to the selfsame further filter component.

4. A method as in claim 3, wherein the step of leaving the filter component in the wrap includes a subsidiary step of directing pushing means through the tubular element toward the further filter component so as to position the at least one filter component in close proximity to the further filter component.

5. A method as in claim 4, wherein the step of withdrawing the tubular element from the tubular wrap includes the subsidiary step of distancing the tubular element axially from the further filter component.

6. A method as in claim 5, comprising the step, implemented subsequent to the step of withdrawing the tubular element, of distancing the pushing means from the filter component.

7. A method as in claim 4, comprising the step of inserting at least two filter components consisting in materials dissimilar one from another and constituting a second filter element and a third filter element.

8. A method as in claim 7, wherein the step of inserting the two filter components into the tubular element includes the subsidiary step of positioning a second filter element of powder or granular material and a third filter element, in close proximity one to another, internally of the tubular element.

9. A method as in claim 1, wherein the step of folding the leaf of material around the tubular element includes the subsidiary steps of pressing first one member and then the other member of the leaf flat against the outer surface of the tubular element.

10. A method as in claim 2, comprising the step of placing two tubular elements against the inner surface of the leaf on opposite sides of the further filter component.

11. A method as in claim 10, wherein the two tubular elements are placed symmetrically on either side of the further filter component, and the relative placing step includes the subsidiary steps of moving the tubular elements axially one toward the other and both toward the further filter element.

12. A method as in claim 11, wherein the step of inserting at least one filter component into a tubular element includes a subsidiary step in which two sets of pushing means are caused each to advance axially through a respective tubular element, moving one toward the other and both toward the further filter component.

13. A method as in claim 12, wherein the step of withdrawing the tubular element from the tubular wrap includes the subsidiary step of distancing the two tubular elements axially one from another.

14. A method as in claim 13, comprising the further step, implemented subsequent to the step of withdrawing the tubular elements, of distancing the pushing means axially one from another.

15. A method as in claim 1, comprising the step of inserting two filter components into each tubular element, of which at least one consists in a powder or granular material.

16. A method as in claim 7, comprising the steps of directing the powder or granular material into dispensing valve means, and dispensing a predetermined measure of the powder or granular material into the tubular element through the agency of the valve means, wherein the measure of material constitutes the second filter element.

17. A method as in claim 16, comprising the step of locating the third filter element in the tubular element in such a way that it will be interposed between the pushing means and the second filter element.

* * * * *